US005867090A

United States Patent [19]

Chen

[11] Patent Number: 5,867,090

[45] Date of Patent: Feb. 2, 1999

[54] DIAPHRAGM BUZZER

[76] Inventor: Chau-Ho Chen, 5F, No. 3, Alley 6, Lane 45, Pao-Hsing Rd., Hsing-Tien City, Taipei, Taiwan

[21] Appl. No.: 359,631

[22] Filed: Dec. 20, 1994

[51] Int. Cl.[6] ..... G08B 3/00

[52] U.S. Cl. ..... 340/388.1; 340/388.3; 340/391.1; 116/142 R; 381/190; 381/191

[58] Field of Search ..... 390/389.1, 388.1, 390/388.3, 388.4, 391.1; 116/137 R, 142 R, 145; 381/190, 191, 203

[56] References Cited

U.S. PATENT DOCUMENTS 4,175,262 11/1979 Harakawa et al. ..... 340/391.1
4,284,857 8/1981 Slavin et al. ..... 340/391.1
4,810,997 3/1989 Kudo et al. ..... 340/384.6
4,823,110 4/1989 Dorward et al. ..... 340/391.1

*Primary Examiner*—Edward Lefkowitz
*Attorney, Agent, or Firm*—Morton J. Rosenberg; David I. Klein; Jun Y. Lee

[57] ABSTRACT

Disclosed is a diaphragm buzzer including a lower cover and an upper cover. A sheet buzz element having a centered diaphragm is disposed inside the lower and the upper cover and is protectively sandwiched between a press plate and a plastic washer before it is fixed to the upper cover, lest the sheet buzz element should detach from the wires connecting it to a circuit board and become loose and damaged in the two covers.

1 Claim, 2 Drawing Sheets

DIAPHRAGM BUZZER

BACKGROUND OF THE INVENTION

The present invention relates to a diaphragm buzzer, and more particularly to a buzzer which consists of an upper and a lower covers to contain a sheet buzz element therein. The sheet buzz element is further protected by disposing a press plate and a plastic washer at two sides thereof.

Generally, a conventional diaphragm buzzer is so structured that a sheet buzz element is attached to a circuit board by means of a bonding agent and is then fixed to an upper cover of the buzzer. With this fixing manner, any damaged sheet buzz element in the buzzer can not be separately replaced and the whole set of buzzer must be discarded.

In the conventional diaphragm buzzer, the sheet buzz element is disposed between the circuit board and the upper cover. To fix the sheet buzz element in place, the same is positioned in a fixing disc formed inside the upper cover with the circuit board positioned at another side of the buzz element, then, a bonding agent is used to fasten the sheet buzz element to the upper cover. Wires connecting the circuit board and the buzz element are completely wound and pressed into the space between the circuit board and the buzz element. The shortcomings of the conventional diaphragm buzzer so sturctured include:

1. Connecting wires wound and pressed inside the buzzer causes larger space between the circuit board and the sheet buzz element, and therefore, the sheet buzz element is subject to shake when the buzzer is vibrated. A shaking buzz element can not be positively examined when it is damaged.

2. When the sheet buzz element is damaged, it can not be separately replaced but has to be discarded along with the circuit board and the upper cover which are still usable.

SUMMARY OF THE INVENTION

To eliminate the above-mentioned disadvantages that existed in the conventional diaphragm buzzer, the present invention provides a diaphragm buzzer which includes a pair of upper and lower covers. The upper cover is provided with a round fixing seat on an inside portion thereof. A plastic washer, a sheet buzz element, a press plate, and a circuit board are sequentially mounted into the round fixing seat and are fixed therein by means of screws, so that there is a tolerance space left at each side of the sheet buzz element to fully protect and fix it and allow it to function correctly.

DETAILED DESCRIPTION OF THE PREFERRED EMBODIMENT

Figure 1:
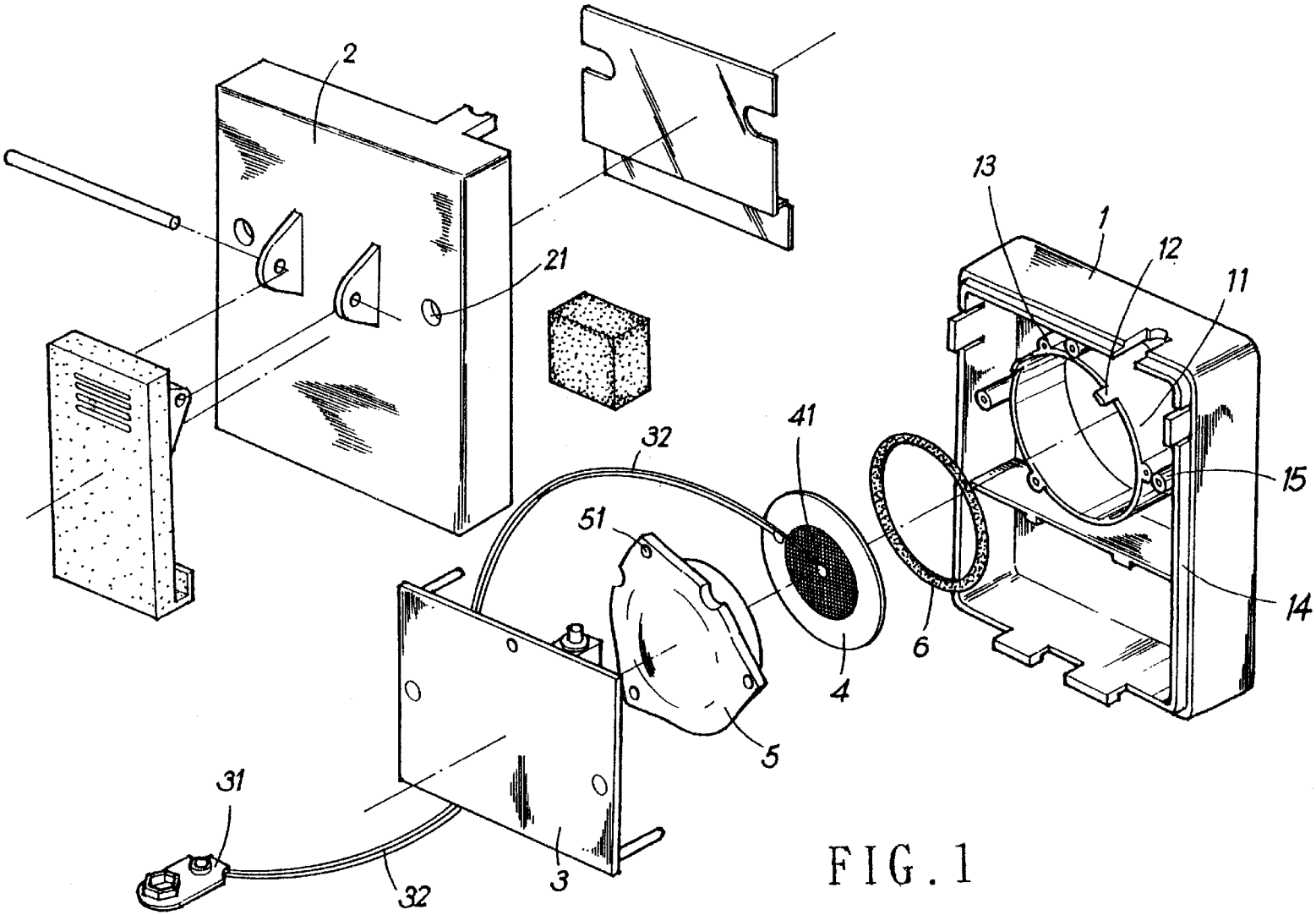
FIG. 1 is a disassembled perspective of a diaphragm buzzer according to the present invention.
Figure 2:
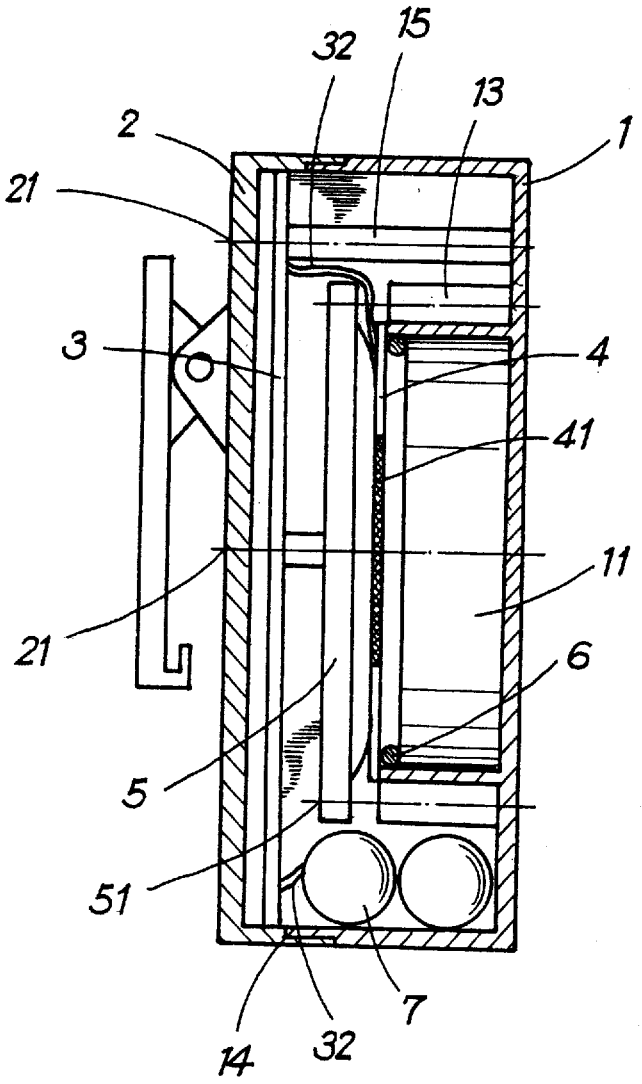
FIG. 2 is a sectional view showing an assembled diaphragm buzzer shown in FIG. 1.

Please refer to FIGS. 1 and 2. A diaphragm buzzer according to the present invention includes an upper cover 1 and a lower cover 2. The lower cover 2 is provided at its outer side with two connecting ears for pivotally connecting a back clip. Two through holes 21 are separately formed on the lower cover 2 at outer side of each connecting ear for mounting purpose. The lower cover 2 has peripheral side walls corresponding to the periphery of the upper cover 1. A sponge, an escutcheon, and a circuit board 3 are sequentially disposed in the lower cover 2 in advance. The circuit board 3 is connected to a battery button 31 and a sheet buzz element 4 by means of wires 32. A press plate 5 is disposed between the circuit board 3 and the sheet buzz element 4 and has a substantially triangular configuration with two convex side faces. One of the side faces of the press plate 5 which faces outward (that is, faces the upper cover 1) is more convex than the other side face so as to protect the sheet buzz element 4 from being damaged by an out coming force. A plastic washer 6 is similarly disposed at another side of the sheet buzz element 4 opposite to the press plate 5. The plastic washer 6 is completely positioned in a fixing seat 11 formed inside the upper cover 1 such that the sheet buzz element 4 is stably fixed and not subjected to any external influence.

The upper cover 1 has the same configuration as that of the lower cover 2 but is disposed opposite to the lower cover 2. The upper cover 1 also has peripheral side walls 14 and has an internal partition to divide its inner space into a lower compartment and an upper compartment. The lower compartment of the upper cover 1 is used to contain batteries 7 and the upper compartment has the round fixing seat 11 centered therein. The fixing seat 11 has two projections 12 axially provided on its circumference at proper positions to engage into two mounting recesses formed on the press plates 5. In addition, fixing holes 13 are formed and equally spaced on an outer wall surface of the round fixing seat 11 to receive screws threaded through the press plate 5 and extended into the fixing holes 13. There are also three fixing holes 15 formed at an inner side of the side walls 14 of the upper cover 1 so that the lower cover 2 is screwed to the upper cover 1 via the fixing holes 15 by means of screws.

The sheet buzz element 4 has a centered diaphragm 41 to which the wires 32 from the circuit board 3 are connected. Since the diaphragm 41 is subject to vibration, the sheet buzz element 4 is particularly protected by sandwiching it between the press plate 5 and the plastic washer 6, lest the buzz element 4 should become loose. Moreover, wires 32 will not be over twisted and wound between the circuit board 3 and the sheet buzz element 4.

While a specific embodiment of the invention has been shown and described in details to illustrate the application of the principles of the invention, it will be understood that the invention may be embodied otherwise without departing from such principles.

What is claimed is:

1. A diaphragm buzzer comprising:

an upper cover having a first perimeter wall to define an internal cavity thereof, said internal cavity being divided into a lower compartment and an upper compartment, said upper compartment having a centrally disposed circular seat formed therein;

a battery power source disposed in said lower compartment;

a plastic washer disposed in said circular seat;

a press plate having a plurality of openings formed therethrough adjacent a perimeter edge thereof, said press plate being disposed in overlying relationship with said circular seat and releasably coupled to said upper cover by a plurality of fasteners respectively extending through said plurality of openings and engaging first mounting means formed in said upper compartment adjacent a perimeter portion of said circular seat;

a sheet buzz element disposed in said circular seat and sandwiched between said plastic washer and said press plate, said sheet buzz element having a centered diaphragm formed thereon;

a lower cover releasably coupled to said upper cover for enclosing said plastic washer, said sheet buzz element, and said press plate therebetween, said lower cover having a second perimeter wall to define a cavity therein and a pair of openings formed therethrough, said lower cover being releasably coupled to said upper cover by a pair of fasteners respectively extending through said pair of openings of said lower cover and engaging second mounting means formed in opposing sides of said upper compartment with said second perimeter wall being disposed in abutting relationship with said first perimeter wall; and, a circuit board disposed in said lower cover cavity and electrically coupled to said centered diaphragm, said circuit board including a connector for electrically coupling said battery power source thereto.

* * * * *